United States Patent [19]

Lapeyre

[11] 4,328,880

[45] * May 11, 1982

[54] CIRCULAR LADDER

[75] Inventor: James M. Lapeyre, New Orleans, La.

[73] Assignee: The Laitram Corporation, New Orleans, La.

[ * ] Notice: The portion of the term of this patent subsequent to Apr. 22, 1997, has been disclaimed.

[21] Appl. No.: 155,535

[22] Filed: Jun. 2, 1980

[51] Int. Cl.[3] ..... E06C 9/02; E06C 7/08

[52] U.S. Cl. ..... 182/93; 182/99; 182/106; 182/194; 52/187

[58] Field of Search ..... 182/94, 194, 106, 100, 182/189, 99; 52/187

[56] References Cited

U.S. PATENT DOCUMENTS

| | | | |
|---|---|---|---|
| 2,085,839 | 6/1937 | Van Dyke | 182/93 |
| 4,199,040 | 4/1980 | Lapeyre | 182/93 |
| 4,215,766 | 8/1980 | Littlefield | 182/178 |

*Primary Examiner*—Reinaldo P. Machado
*Attorney, Agent, or Firm*—Weingarten, Schurgin & Gagnebin

[57] ABSTRACT

A circular ladder for use along a cylindrical wall and having a single stringer which is disposed in a helical path around the cylindrical wall and an array of half treads disposed on each side of the stringer. Each array of half treads is vertically spaced from the other along the length of the stringer, the half treads being affixed to and laterally extending from the respective sides of the stringer. Each half tread includes an outwardly extending portion which terminates in a plane which is forward of a plane passing through the front edges of the treads. First and second handrails are disposed in this forward plane and affixed to the outwardly extending tread portions. In an alternative embodiment, a single outside handrail is employed, the cylindrical wall providing a body support in place of an inside handrail.

5 Claims, 7 Drawing Figures

CIRCULAR LADDER

FIELD OF THE INVENTION

This invention relates to ladders, and more particularly, to a circular ladder for attachment to a cylindrical structure such as a tank, silo, stack, and the like.

BACKGROUND OF THE INVENTION

Ladders or stairs employed with a cylindrical tank or other cylindrical structure are often affixed to the tank wall and are disposed along a helical path along the tank wall. The ladders are constructed in conventional manner with treads of sufficient width to accommodate both feet of a user standing upon the tread, the treads being supported by stringers extending along the ladder way. In ascending or descending a ladder, the right foot of a user steps upon the right-hand portion of a tread, and the left foot steps upon the left-hand portion of the next tread. Thus, alternate treads are employed by each foot of the user, and it is not usually necessary to stand upon a single tread with both feet during ascent or descent of a ladder. Since only half of a tread is being used, the presence of a full-width tread in a conventional ladder is wasteful of material and adds to the weight of the overall ladder structure. The presence of a full-width tread also presents an obstacle to the movement of a user's foot in ascending or descending the ladder, creating an unnecessary safety hazard for the user. The inclination of a conventional ladder must be such that a user can move his foot past the unused portion of a tread in moving to the next tread, thereby limiting the angle of inclination.

In U.S. Pat. No. 4,199,040, issued Apr. 22, 1980, entitled Ship Ladder, and assigned to the same assignee as this invention, an improved ladder is disclosed which comprises a single stringer or central tread support disposed between upper and lower levels at a predetermined angle of inclination and having an array of half treads on each side of the stringer, each array being vertically spaced from the other along the length of the stringer. The half treads are affixed to, and laterally extend from, the respective sides of the stringer, and each includes an integral outwardly extending portion which terminates in a plane which is forward of a plane passing through the front edges of the treads. First and second handrails are disposed in this forward plane and are affixed to and supported by the outwardly extending tread portions. This novel ladder can be disposed at a relatively steep angle in comparison to a conventional ladder of the same tread width and riser height and provides sufficient safety and comfort to permit balanced use of the ladder even without holding onto the handrails.

Ladders are known in which treads or rungs are alternately arranged along a single stringer or pole. In ascending and descending ladders of this known type, a user must face the ladder and support himself by holding onto the rungs to guide his ascent or descent. Such ladders of known construction cannot be readily descended facing forward, as with a stairway, and these known ladders also require a fair degree of dexterity on the part of a user and are not very comfortable to use.

SUMMARY OF THE INVENTION

The present invention provides a circular ladder which is similar to the ladder of the aforesaid Patent 4,199,040 and which is constructed and operative for use on a cylindrical wall, such as a tank, silo, or stack. The circular ladder comprises a single stringer which is disposed in a helical path around the cylindrical wall of an associated structure on which the ladder is installed. An array of half treads are disposed on each side of the stringer, each array being vertically spaced from the other along the length of the stringer. The half treads are affixed to and are laterally extending from the respective sides of the stringer, and each half tread includes an outwardly extending portion which terminates in a plane which is forward of a plane passing through the front edges of the treads. In one embodiment, first and second handrails are disposed in this forward plane and are affixed to the outwardly extending tread portions. Some or all of the treads contiguous with the cylindrical wall are affixed to the wall, such as by welding or bolting. In another embodiment, only a single outside handrail is employed, the tank wall providing a body support in place of an inside handrail. This novel ladder can be disposed at a relatively steep angle to provide more rapid ascent and descent with safety and comfort to a user. The novel ladder is also relatively narrow with high handrails for improved comfort and security of the user, since the user is, in effect, partially enclosed within the ladder structure.

DESCRIPTION OF THE DRAWINGS

The invention will be more fully understood from the following detailed description taken in conjunction with the accompanying drawings, in which.

DETAILED DESCRIPTION OF THE INVENTION

The novel circular ladder is described for use on a cylindrical structure. It is not intended to limit the invention to true cylindrical configurations, as the invention contemplates more broadly a curved ladder which is disposed on any correspondingly curved surface.

Figure 1:
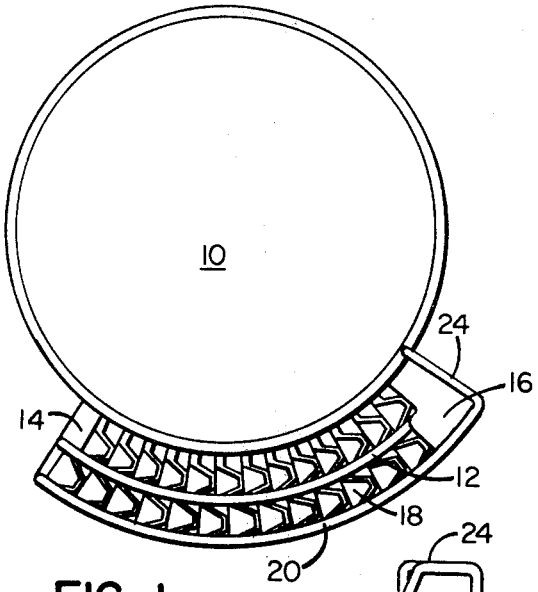
FIG. 1 is a top view of a circular ladder according to the invention.
Figure 2:
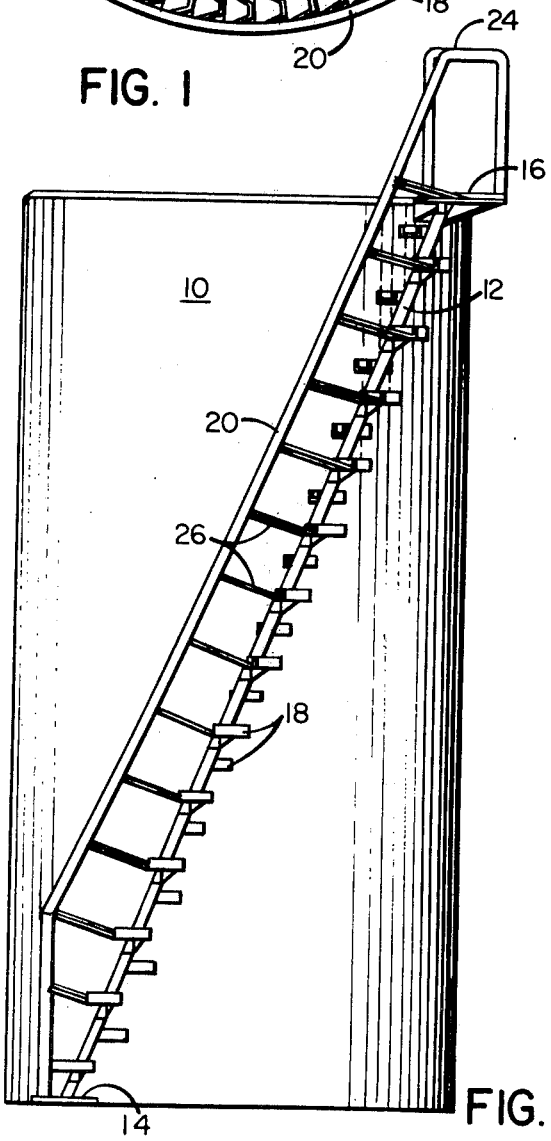
FIG. 2 is an elevation view of the embodiment of FIG. 1.
Figure 3:
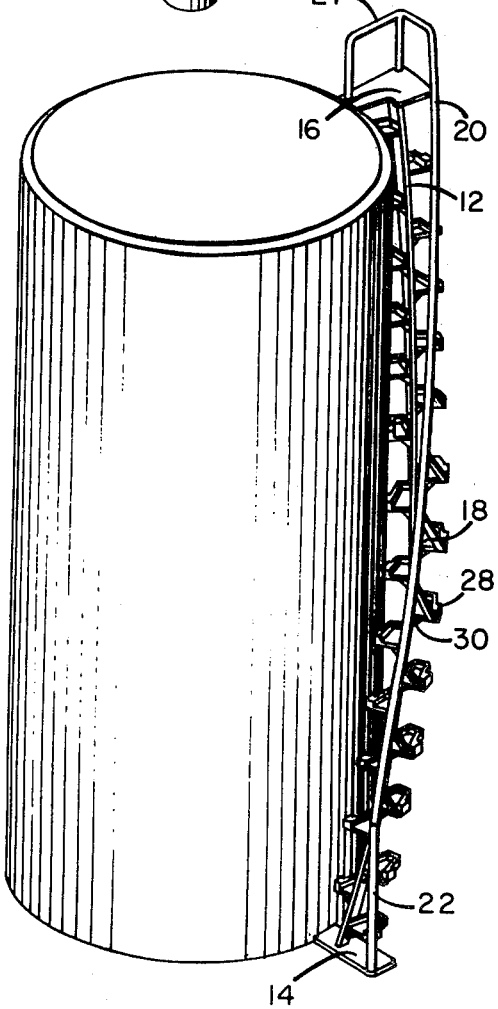
FIG. 3 is a pictorial view of the embodiment of FIGS. 1 and 2.

Referring to FIGS. 1–3, a circular ladder is shown disposed about the wall of a tank or other cylindrical vessel 10. The ladder comprises a stringer 12 disposed between a lower surface 14 and an upper landing surface 16, and an array of half treads 18 alternately disposed along respective sides of stringer 12 and equally spaced along the length thereof. Each half tread 18 includes a laterally extending portion configured to accommodate the foot of a person using the ladder. The inner plurality of half treads is affixed to the confronting tank wall such as by welding. A handrail 20 is disposed along a curved path generally parallel to that of stringer 12 and the wall of tank 10. In the illustrated embodiment, the handrail includes a lower vertical portion 22 and at its upper end is joined to a railing 24. The handrail 20 is affixed to the outermost half treads 18 by means of balusters or struts 26, each affixed to or integral with a respective half tread. The struts 26 terminate at a plane forward and parallel to a plane passing through the front edges of the foot support portions of the half treads. This handrail is positioned at a convenient distance forward of the treads so that a person using the ladder will feel secure in its use. The ladder can be ascended facing forward and can be descended facing outward from the ladder, as in descending a conventional stairway, rather than the rearward descent on a rung-type ladder. The half treads are of a size to accommodate the foot of a user and of sufficient size to accommodate the normal outward angling of a foot. The half treads 18 in the illustrated embodiment include a bracing wall portion 28 and a bracing plate 30.

Figure 4:
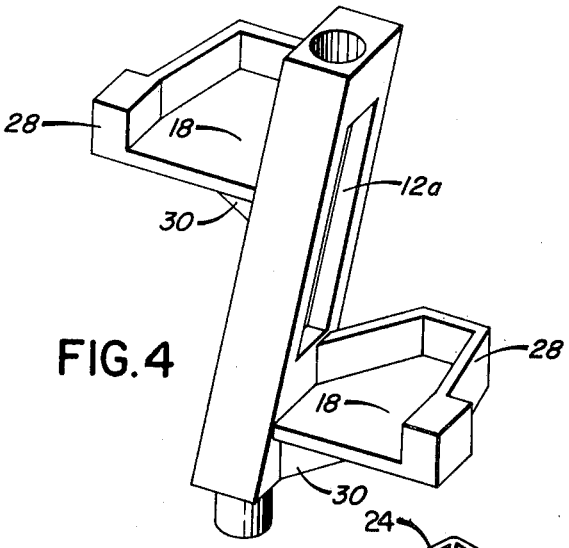
FIG. 4 is a pictorial view of a modular unit useful in the invention.

The alternating half treads can be fabricated such as by metal casting as modular units which can be interconnected to provide a circular ladder of intended height. One modular unit of the type which can be employed in this embodiment is shown in FIG. 4 and includes a pair of spaced half treads 18 disposed on respective sides of a stringer section 12*a*. Like units can be welded together and to the tank wall to form a rigid structure.

Figure 5:
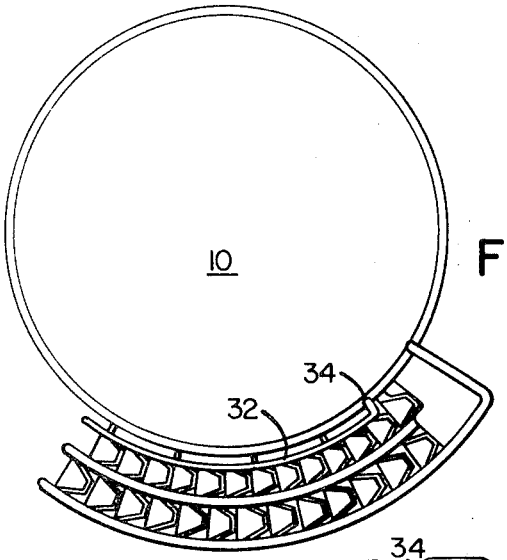
FIG. 5 is a top view of an alternative embodiment of the circular ladder.
Figure 6:
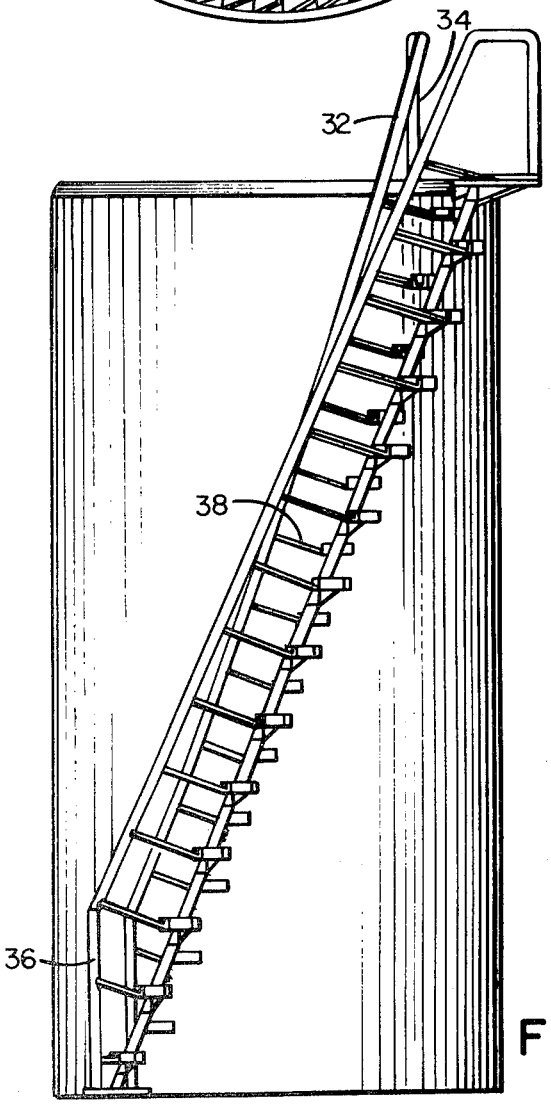
FIG. 6 is an elevation view of the embodiment of FIG. 5.
Figure 7:
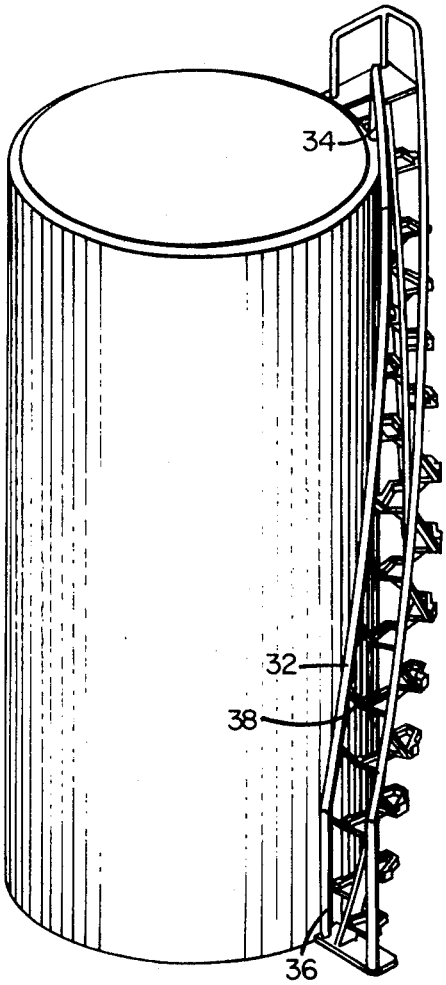
FIG. 7 is a pictorial view of the embodiment of FIGS. 5 and 6.

In the embodiment of FIGS. 1–3, the tank wall provides a body support in place of an inside handrail. In the alternative embodiment depicted in FIGS. 5–7, an inside handrail 32 is provided and is affixed to the upper portion of tank 10 by a vertical section 34, and to the lower mounting surface by a vertical section 36, and is affixed to the confronting half treads by means of struts 38. The inner handrail 32 is spaced from the tank wall for hand clearance, and some or all of the half treads can be attached to the tank wall for structural support.

The novel ladder can be disposed at a relatively steep angle in comparison to a ladder of conventional construction to provide more rapid ascent and descent with safety and comfort to a user. The user is partially enclosed within the ladder during use to provide improved comfort and security. The ladder employs less floor space and overhead space to accommodate its horizontal run by reason of its greater inclination, in comparison to a ladder of conventional construction which provides the same degree of comfort and safety. To accommodate the usual range of adult sizes the half-tread width (side to side extension) typically can be about 5–8 inches; the length of the tread (fore and aft extension) can be about 4–11 inches; and the riser height between adjacent treads can be about 6–12 inches.

In the embodiments illustrated herein, the stringers and handrails are of tubular metal, and the treads and braces are of metal welded to the tubular components. Cast modular units can also be employed as described above. Various other constructions can be utilized, such as shown and described in Patent 4,199,040.

The invention is not to be limited except as indicated in the appended claims.

What is claimed is:

1. A ladder for use along a curved wall and comprising:

a single stringer adapted for mounting between an upper level and a lower level at a predetermined angle of inclination and disposed in a curved path substantially parallel to a curved mounting wall;

a first plurality of half tread members disposed on one side of said stringer and spaced along the length thereof;

a second plurality of half tread members disposed along the opposite side of said stringer and spaced along the length thereof;

said first and second plurality of tread members being disposed in alternating arrangement on respective sides of said stringer;

each of said half tread members having a foot support portion outwardly extending from said stringer, the first plurality of half tread members being attached to the curved mounting wall, and at least said second plurality of half tread members having rail support means outwardly extending from the foot support portion and terminating substantially in a plane forward and parallel to a plane passing through the front edges of the foot support portions; and a handrail attached to said rail support means and lying in the forward plane.

2. The ladder of claim 1 including a second handrail lying in the forward plane and attached to the rail support means of the other of said first and second plurality of tread members.

3. The ladder of claim 1 wherein the rail support means are integral with the foot support means.

4. The ladder of claim 2 wherein the handrails are positioned to provide support to the sides of a user's body.

5. The ladder of claim 1 wherein each pair of alternating half-tread members and a section of said stringer are fabricated as a modular unit attachable to like modular units to provide a ladder of intended length.

* * * * *